US006966627B2

(12) United States Patent
Escobedo et al.

(10) Patent No.: US 6,966,627 B2
(45) Date of Patent: Nov. 22, 2005

(54) PRINTHEAD ORIENTATION

(75) Inventors: Victor T. Escobedo, Bonita, CA (US); Kenneth J. Courian, San Diego, CA (US); Scott Hock, Poway, CA (US); John Wade, Ramona, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 108 days.

(21) Appl. No.: 10/608,642

(22) Filed: Jun. 27, 2003

(65) Prior Publication Data

US 2004/0263563 A1 Dec. 30, 2004

(51) Int. Cl.[7] ..... B41J 2/15; B41J 2/135

(52) U.S. Cl. ..... 347/41; 347/44

(58) Field of Search ..... 347/9–12, 20, 347/40–44, 37, 54, 68

(56) References Cited

U.S. PATENT DOCUMENTS

| | | | | |
|---|---|---|---|---|
| 4,091,390 | A | 5/1978 | Smith et al. | |
| 4,809,016 | A | 2/1989 | Padalino | |
| 5,581,284 | A * | 12/1996 | Hermanson | 347/43 |
| 5,781,212 | A * | 7/1998 | Burr et al. | 347/84 |
| 6,183,063 | B1 | 2/2001 | Bolash et al. | |
| 6,183,078 | B1 | 2/2001 | Pietrzyk et al. | |
| 6,474,765 | B2 | 11/2002 | Beauchamp | |
| 6,523,934 | B1 | 2/2003 | Beauchamp et al. | |
| 6,793,319 | B2 * | 9/2004 | Ikemoto et al. | 347/40 |

* cited by examiner

*Primary Examiner*—Stephen Meier
*Assistant Examiner*—An H. Do

(57) ABSTRACT

A printhead for printing on a print media includes a column of nozzles oriented at an angle to an axis of relative movement between the printhead and the print media, and a print axis oriented substantially parallel to the axis of relative movement between the printhead and the print media such that at least some of the nozzles are variably aligned to the print axis.

47 Claims, 5 Drawing Sheets

PRINTHEAD ORIENTATION

CROSS-REFERENCE TO RELATED APPLICATIONS

This application is related to U.S. patent application Ser. No. 10/460,276, entitled "Printhead Orientation", filed on Jun. 11, 2003.

BACKGROUND

An inkjet printing system may include a printhead and an ink supply which supplies liquid ink to the printhead. The printhead ejects ink drops through a plurality of orifices or nozzles and toward a print media, such as a sheet of paper, so as to print onto the print media. Typically, the nozzles are arranged in one or more arrays such that properly sequenced ejection of ink from the nozzles causes characters or other images to be printed upon the print media as the printhead and the print media are moved relative to each other.

Nozzles of the printhead are often arranged in one or more columns with nozzles within a respective column having an established nozzle-to-nozzle spacing. This nozzle-to-nozzle spacing affects the number of dots-per-inch (dpi) or resolution that the printhead can print. Thus, reducing the spacing between nozzles can result in increased resolution of the printhead. Physical limitations, however, may limit the spacing between nozzles within a respective column.

In addition, during printing, nozzles of the printhead may malfunction. For example, nozzles may become obstructed or clog or become inoperative for some other reason. Furthermore, during printing, printing speed of the printhead is limited by how many drops can be ejected through the nozzles along a certain path.

For these and other reasons, there is a need for the present invention.

SUMMARY

One aspect of the present invention provides a printhead for printing on a print media. The printhead includes a column of nozzles oriented at an angle to an axis of relative movement between the printhead and the print media, and a print axis oriented substantially parallel to the axis of relative movement between the printhead and the print media such that at least some of the nozzles are variably aligned to the print axis.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
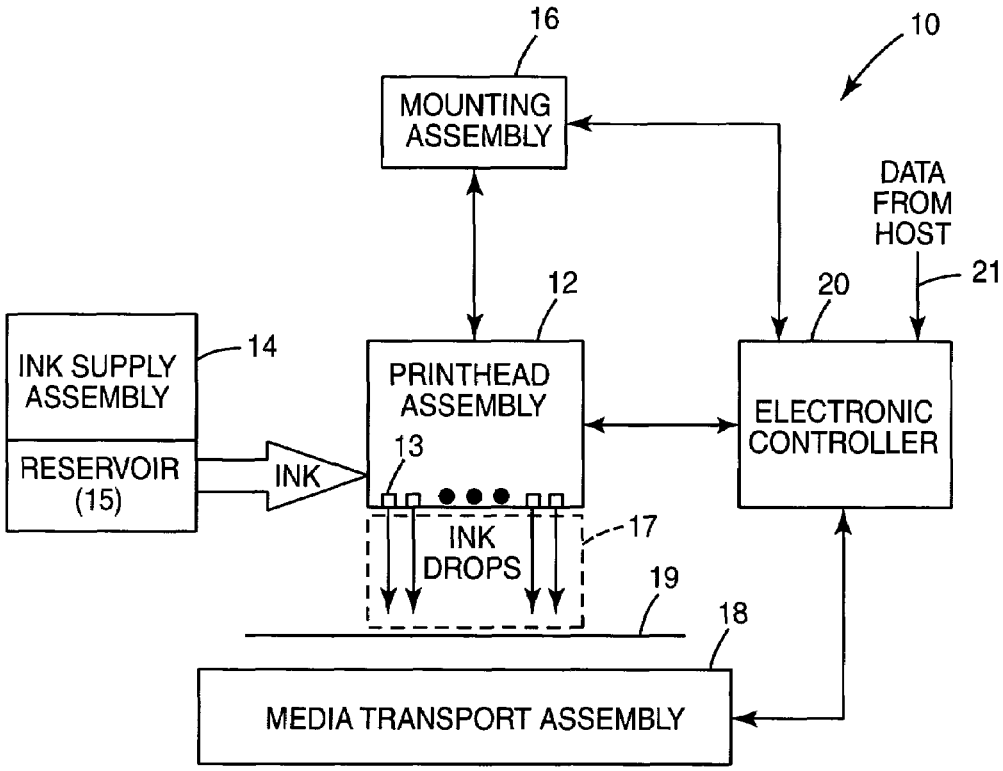
FIG. 1 is a block diagram illustrating one embodiment of an inkjet printing system according to the present invention.

FIG. 1 illustrates one embodiment of a portion of an inkjet printing system 10. Inkjet printing system 10 includes a printhead assembly 12, an ink supply assembly 14, a mounting assembly 16, a media transport assembly 18, and an electronic controller 20. Printhead assembly 12 includes one or more printheads which eject drops of ink, including one or more colored inks or UV readable inks, through a plurality of orifices or nozzles 13. While the following description refers to the ejection of ink from printhead assembly 12, it is understood that other liquids, fluids, or flowable materials, including clear fluid, may be ejected from printhead assembly 12.

In one embodiment, the drops of ink are directed toward a medium, such as a print media 19, so as to print onto print media 19. Typically, nozzles 13 are arranged in one or more columns or arrays such that properly sequenced ejection of ink from nozzles 13 causes characters, symbols, and/or other graphics or images to be printed upon print media 19 as printhead assembly 12 and print media 19 are moved relative to each other.

Print media 19 includes any type of suitable sheet material, such as paper, card stock, envelopes, labels, transparencies, Mylar, and the like. In one embodiment, print media 19 is a continuous form or continuous web print media 19. As such, print media 19 may include a continuous roll of unprinted paper.

Ink supply assembly 14 supplies ink to printhead assembly 12 and includes a reservoir 15 for storing ink. As such, in one embodiment, ink flows from reservoir 15 to printhead assembly 12. In one embodiment, printhead assembly 12 and ink supply assembly 14 are housed together in an inkjet print cartridge or pen. In another embodiment, ink supply assembly 14 is separate from printhead assembly 12 and supplies ink to printhead assembly 12 through an interface connection, such as a supply tube.

Mounting assembly 16 positions printhead assembly 12 relative to media transport assembly 18, and media transport assembly 18 positions print media 19 relative to printhead assembly 12. As such, a print region 17 within which printhead assembly 12 deposits ink drops is defined adjacent to nozzles 13 in an area between printhead assembly 12 and print media 19. In one embodiment, print media 19 is advanced through print region 17 during printing by media transport assembly 18.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, an image, graphics, or pattern to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry is located off printhead assembly 12.

Figure 2:
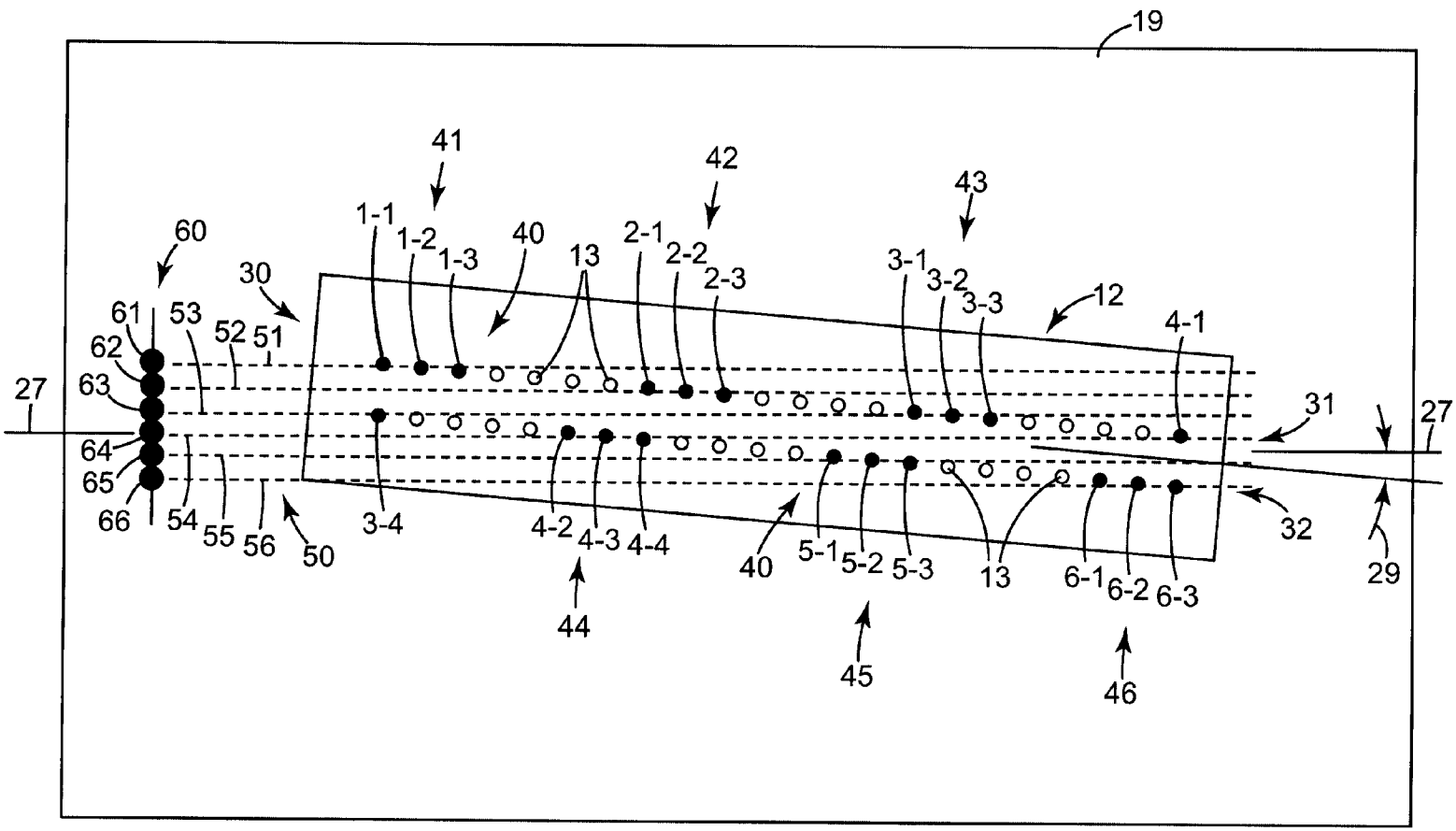
FIG. 2 is a schematic illustration of one embodiment of a printhead according to the present invention.

As illustrated in the embodiment of FIG. 2, printhead assembly 12 includes at least one column 30 of nozzles 13. In one exemplary embodiment, printhead assembly 12 includes two columns 31 and 32 of nozzles 13. Columns 31 and 32 of nozzles 13 are spaced from and oriented substantially parallel to each other. It is understood that FIG. 2 is a simplified schematic illustration of one embodiment of printhead assembly 12 and that the size, spacing, and number of nozzles 13 of printhead assembly 12, for example, has been simplified for clarity of the invention.

As described above, printhead assembly 12 and print media 19 are moved relative to each other during printing. For example, printhead assembly 12 is moved relative to print media 19 during printing and/or print media 19 is moved relative to printhead assembly 12 during printing. As such, an axis 27 of relative movement between printhead assembly 12 and print media 19 is established. In one embodiment, printhead assembly 12 is aligned to axis 27 such that column 30 (including columns 31 and 32) of nozzles 13 is oriented at an angle 29 to axis 27. In one embodiment, angle 29 is an acute angle.

In one embodiment, as illustrated in FIG. 2, nozzles 13 of printhead assembly 12 are divided into nozzle subgroups 40. In addition, printhead assembly 12 includes a plurality of print axes 50 such that each print axis 50 extends through one nozzle subgroup 40. In one embodiment, each print axis 50 is oriented substantially parallel to axis 27 such that nozzles 13 within each nozzle subgroup 40 are variably aligned to one print axis 50, as described below.

As illustrated in the embodiment of FIG. 2, each nozzle subgroup 40 includes two or more nozzles 13. In addition, each nozzle subgroup 40 includes nozzles 13 from one or more columns 30 of nozzles 13. For example, nozzle subgroup 41 includes three nozzles identified as 1-1, 1-2, and 1-3 from column 31, nozzle subgroup 42 includes three nozzles identified as 2-1, 2-2, and 2-3 from column 31, nozzle subgroup 43 includes four nozzles identified as 3-1, 3-2, 3-3, and 3-4 from columns 31 and 32, nozzle subgroup 44 includes four nozzles identified as 4-1, 4-2, 4-3, and 4-4 from columns 31 and 32, nozzle subgroup 45 includes three nozzles identified as 5-1, 5-2, and 5-3 from column 32, and nozzle subgroup 36 includes three nozzles identified as 6-1, 6-2, and 6-3 from column 32.

In addition, in one embodiment, one or more nozzle subgroups 40 include adjacent nozzles 13 from one column 30 of nozzles 13. For example, nozzle subgroup 41 includes adjacent nozzles 1-1, 1-2, and 1-3 from column 31, and nozzle subgroup 44 includes adjacent nozzles 4-2, 4-3, and 4-4 from column 32.

In one embodiment, to print on print media 19, printhead assembly 12 is operated to eject ink through one or more nozzles 13 within each nozzle subgroup 40 so as to produce a dot pattern 60 on print media 19 along a respective print axis 50. For example, ink is ejected through one or more nozzles 13 within nozzle subgroup 41 to produce a dot pattern 61 on print media 19 along print axis 51, ink is ejected through one or more nozzles 13 within nozzle subgroup 42 to produce a dot pattern 62 on print media 19 along print axis 52, ink is ejected through one or more nozzles 13 within nozzle subgroup 43 to produce a dot pattern 63 on print media 19 along print axis 53, ink is ejected through one or more nozzles 13 within nozzle subgroup 44 to produce a dot pattern 64 on print media 19 along print axis 54, ink is ejected through one or more nozzles 13 within nozzle subgroup 45 to produce a dot pattern 65 on print media 19 along print axis 55, and ink is ejected through one or more nozzles 13 within nozzle subgroup 46 to produce a dot pattern 66 on print media 19 along print axis 56.

In one embodiment, printhead assembly 12 includes multiple printheads which form a printhead arrangement for printing on print media 19. In one embodiment, the printheads are positioned adjacent to each other and staggered such that adjacent printheads overlap. Thus, printhead assembly 12 may span a nominal page width or a width shorter or longer than nominal page width.

Figure 3:
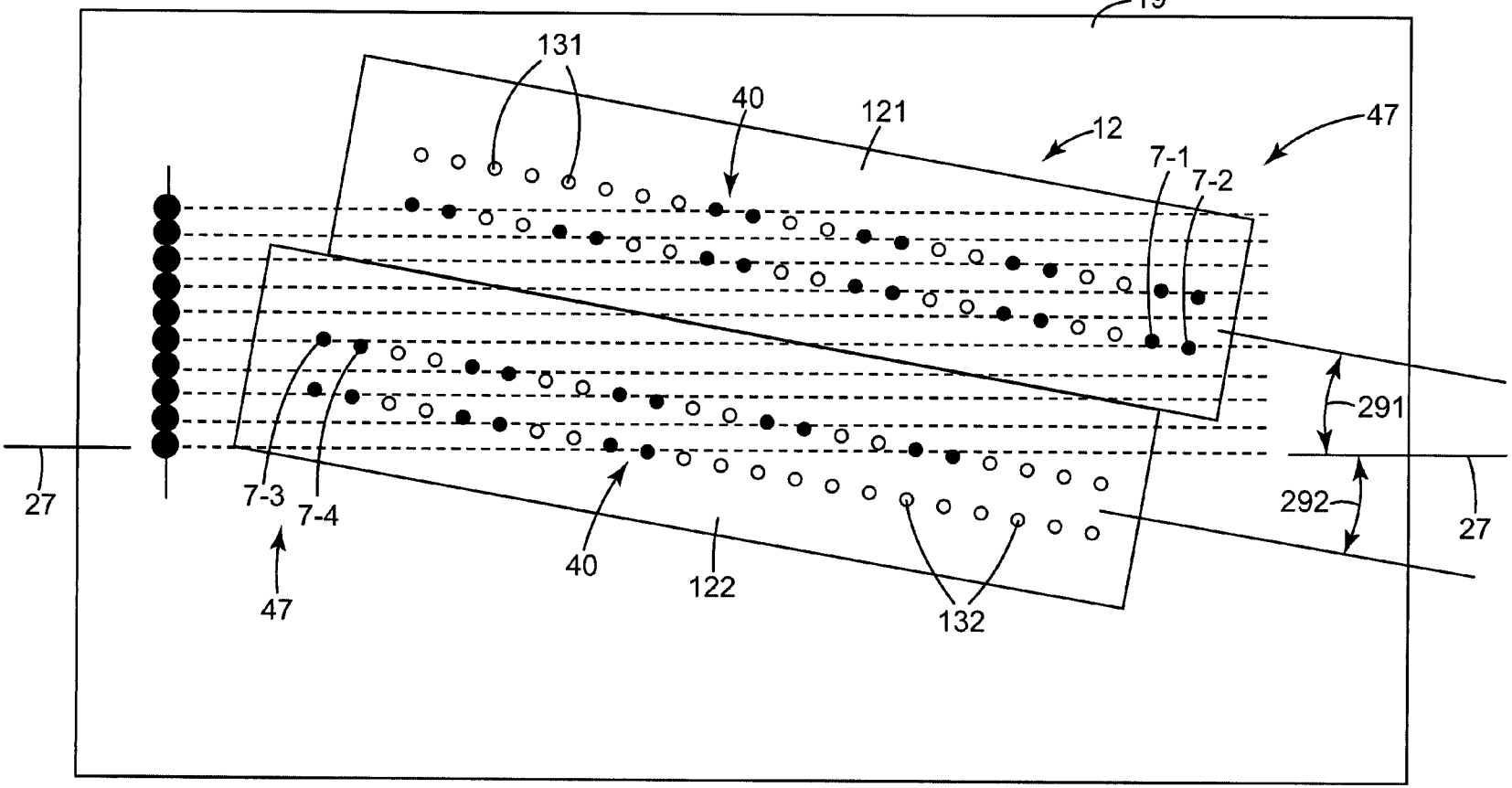
FIG. 3 is a schematic illustration of one embodiment of a printhead arrangement according to the present invention.

As illustrated in the embodiment of FIG. 3, for example, printhead assembly 12 includes printheads 121 and 122. Printheads 121 and 122 are each aligned to axis 27 and include a plurality of nozzles 131 and 132, respectively. Nozzles 131 and 132 of printheads 121 and 122 are each arranged in one or more columns.

In one embodiment, similar to printhead assembly 12, printheads 121 and 122 are aligned to axis 27 such that the columns of nozzles 131 and 132 are oriented at angle 291 and 292, respectively, to axis 27. In addition, nozzles 131 and 132 of printheads 121 and 122 are divided into nozzle subgroups 40. In one embodiment, at least one subgroup of nozzles 131 and 132 includes at least one nozzle from printhead 121 and at least one nozzle from printhead 122. For example, nozzle subgroup 47 includes nozzles 7-1 and 7-2 from printhead 121 and nozzles 7-3 and 7-4 from printhead 122.

Figure 4A:
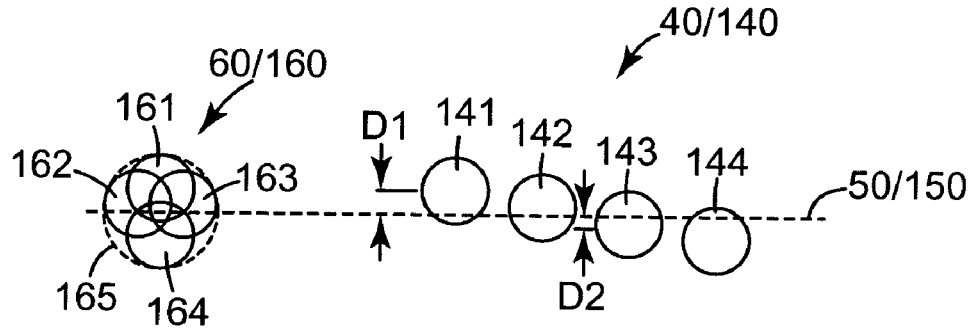
FIG. 4A is a schematic illustration of one embodiment of a nozzle subgroup and one embodiment of a dot pattern created by the nozzle subgroup according to the present invention.
Figure 4B:
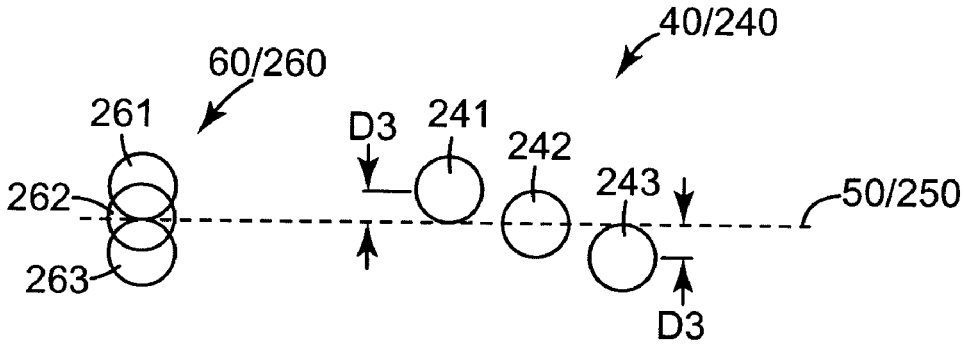
FIG. 4B is a schematic illustration of another embodiment of a nozzle subgroup and one embodiment of a dot pattern created by the nozzle subgroup according to the present invention.
Figure 4C:
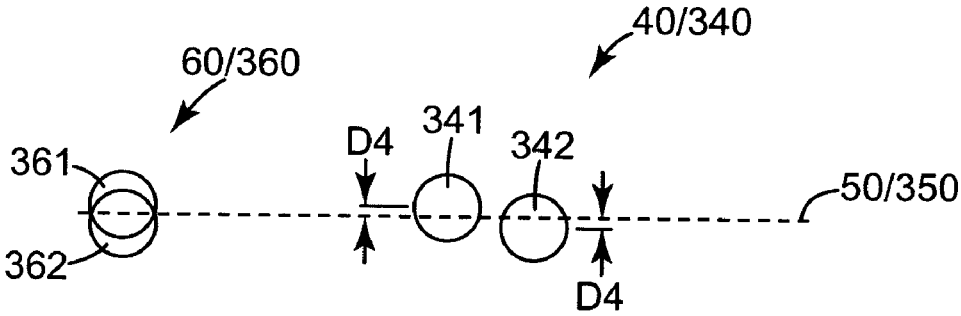
FIG. 4C is a schematic illustration of another embodiment of a nozzle subgroup and one embodiment of a dot pattern created by the nozzle subgroup according to the present invention.

FIGS. 4A, 4B, and 4C illustrate exemplary embodiments of nozzle subgroups 40 and dot patterns 60 produced by the respective nozzle subgroups. As described above, nozzles 13 within nozzle subgroups 40 may include nozzles form one or more columns of nozzles and/or nozzles from one or more printheads. In addition, all nozzles within one nozzle subgroup, less than all nozzles within one nozzle subgroup, only one nozzle within one nozzle subgroup, or any one of the nozzles within one nozzle subgroup may eject ink to print on print media 19 along a respective print axis 50.

As illustrated in the embodiments of FIGS. 4A, 4B, and 4C, print axes 50 pass through nozzle subgroups 40 such that nozzles 13 within each nozzle subgroup 40 are variably aligned to a respective print axis 50. For example, each print axis 50 passes through or adjacent to nozzles 13 within a respective nozzle subgroup 40 at different positions. As such, nozzles 13 within each nozzle subgroup 40 are aligned to a respective print axis 50 in that each print axis 50 passes through or touches the perimeter of nozzles 13 within a respective nozzle subgroup 40. In addition, nozzles 13 within each nozzle subgroup 40 are variably aligned to a respective print axis 50 in that each print axis 50 passes through or adjacent to nozzles 13 within a respective nozzle subgroup 40 at different distances from the centers of the aligned nozzles.

In one embodiment, one or more nozzles within each nozzle subgroup 40 are intersected by a respective print axis 50 at different positions. As such, nozzles 13 within each nozzle subgroup 40 are divided by a respective print axis 50 which passes through or across the respective nozzles. Thus, nozzles intersected by a respective print axis 50 include portions positioned on both sides of the respective print axis 50.

In one embodiment, as illustrated in FIG. 4A, nozzle subgroup 140 includes four nozzles 141, 142, 143, and 144 variably aligned to a print axis 150. For example, print axis 150 passes through nozzles of nozzle subgroup 140 such that nozzle 141 is offset a distance D1 from print axis 150 in one direction and nozzle 143 is offset a distance D2 from print axis 150 in an opposite direction. In addition, in the embodiment of FIG. 4A, nozzles 141, 142, 143, and 144 of nozzle subgroup 140 are each intersected by print axis 150.

In another embodiment, as illustrated in FIG. 4B, nozzle subgroup 240 includes three nozzles 241, 242, and 243 variably aligned to a print axis 250. For example, print axis 250 passes adjacent to and through nozzles of nozzle subgroup 240 such that nozzles 241 and 243 are offset in opposite directions a distance D3 from print axis 250 and nozzle 242 is centered about print axis 250.

In another embodiment, as illustrated in FIG. 4C, nozzle subgroup 340 includes two nozzles 341 and 342 variably aligned to a print axis 350. For example, print axis 350 passes through nozzles of nozzle group 340 such that nozzles 341 and 342 are offset in opposite directions a distance D4 from print axis 350.

As described above, ink is ejected through one or more nozzles 13 within each nozzle subgroup 40 (including nozzle subgroups 140, 240, 340) to print one or more dots on print media 19 and produce dot pattern 60 along a respective print axis 50 (including print axes 150, 250, 350). In one exemplary embodiment, as illustrated in FIG. 4A, ink is ejected through each nozzle 141, 142, 143, and 144 of nozzle subgroup 140 to print a respective dot 161, 162, 163, and 164 along print axis 150 and produce a dot pattern 160. In one embodiment, dots 161, 162, 163, and 164 overlap so as to substantially form a dot 165 of increased size along print axis 150.

In another exemplary embodiment, as illustrated in FIG. 4B, ink is ejected through each nozzle 241, 242, and 243 of nozzle subgroup 240 to print a respective dot 261, 262, and 263 along print axis 250 and produce a dot pattern 260. In one embodiment, dots 261, 262, and 263 overlap so as to increase resolution. More specifically, dots 261, 262, and 263 overlap so as to increase resolution or dots-per-inch (dpi) in a direction substantially perpendicular to print axis 250.

In another exemplary embodiment, as illustrated in FIG. 4C, ink is ejected through either nozzle 341 or 342 of nozzle subgroup 340 to print a respective dot 361 or 362 along print axis 350 and produce a dot pattern 360.

In one embodiment, by dividing nozzles 13 of printhead assembly 12 into nozzle subgroups 40, ink can be ejected through one or more nozzles within nozzle subgroup 40 to produce dot pattern 60 on print media 19 along a respective print axis 50. As such, ink can be ejected through multiple nozzles within each nozzle subgroup 40 to produce overlapping dots along a respective print axis 50. Thus, the overlapping dots can change or increase resolution and/or dot size.

In one embodiment, by dividing nozzles 13 of printhead assembly 12 into nozzle subgroups 40, ink can be ejected through any nozzle within each nozzle subgroup 40 to produce dot pattern 60 on print media 19 along a respective print axis 50. As such, nozzle redundancy is established with the nozzles of a respective nozzle subgroup 40. Nozzle redundancy provides the ability to alternate nozzle activation within a nozzle subgroup. More specifically, ink can be ejected through any one of the nozzles within a respective nozzle subgroup 40 to produce dot pattern 60 along a respective print axis 50. Thus, a defective or inoperative nozzle within a nozzle subgroup can be compensated for by another nozzle within the subgroup.

In one embodiment, by dividing nozzles 13 of printhead assembly 12 into nozzle subgroups 40, ink can be ejected through multiple nozzles within a respective nozzle subgroup 40 to produce dot pattern 60 on print media 19 along a respective print axis 50. As such, printing speed of printhead assembly 12 can be changed or increased since multiple nozzles within a respective nozzle subgroup 40 are available for printing along a respective print axis 50.

It is understood that FIGS. 2, 3, 4A, 4B, and 4C include simplified schematic illustrations of exemplary embodiments of nozzle subgroups 40 (including nozzle subgroups 140, 240, 340). It is also understood, as illustrated in the embodiments of FIGS. 2, 3, 4A, 4B, and 4C, that angle 29 can be varied to vary the number of nozzles 13 within a respective subgroup 40 and/or vary the distance by which nozzles 13 within a respective subgroup 40 are offset from a respective print axis 50. In one embodiment, by varying the number of nozzles 13 within a respective subgroup 40, nozzle redundancy and/or printing speed can be varied since the total number of nozzles available for printing along a respective print axis 50 is varied. In one embodiment, by varying the distance by which nozzles 13 within a respective subgroup 40 are offset from a respective print axis 50, resolution and/or dot size can be varied since the amount of overlap between dots is varied.

Figure 5:
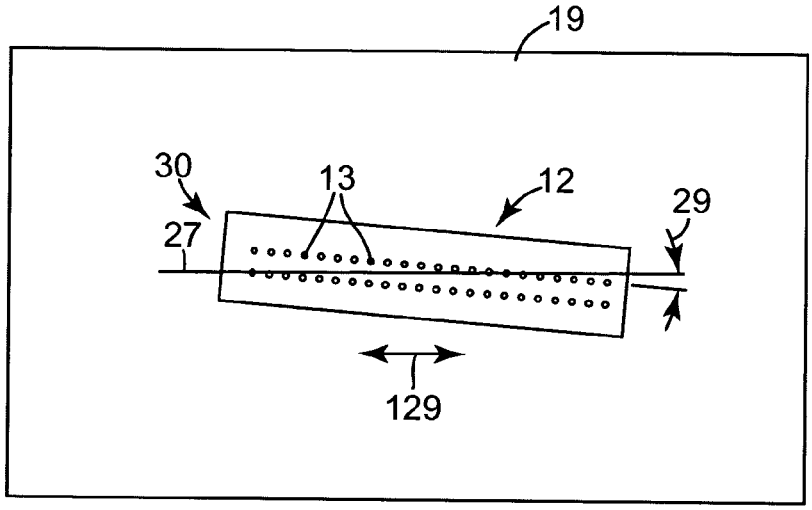
FIG. 5 is a schematic illustration of one embodiment of relative movement between a printhead and a print media according to the present invention.

In one embodiment, as illustrated in FIG. 5 and with reference to FIG. 1, printhead assembly 12 is a scanning type printhead assembly. As such, mounting assembly 16 positions printhead assembly 12 so as to orient column 30 of nozzles 13 at angle 29, as described above. In addition, mounting assembly 16 moves printhead assembly 12 relative to media transport assembly 18 and print media 19 during printing. For example, mounting assembly 16 moves printhead assembly 12 along axis 27 in the directions indicated by double arrow 129.

To move printhead assembly 12, mounting assembly 16 typically includes a carriage and a carriage drive assembly. As such, printhead assembly 12 is removably mounted in, and supported by, the carriage, and the carriage drive assembly moves the carriage and, therefore, printhead assembly 12 relative to print media 19. A conventional carriage drive assembly may include a carriage guide which supports the carriage, a drive motor, and a belt and pulley system which moves the carriage along the carriage guide.

Figure 6:
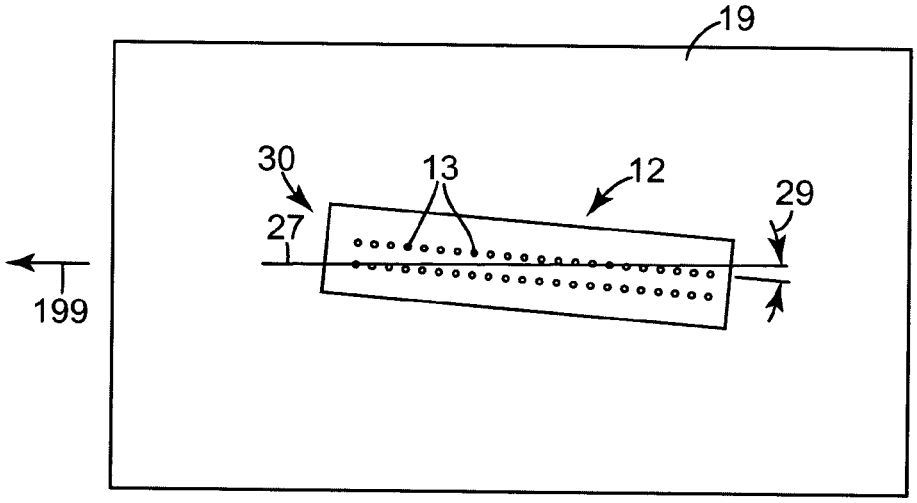
FIG. 6 is a schematic illustration of another embodiment of relative movement between a printhead and a print media according to the present invention.

In another embodiment, as illustrated in FIG. 6 and with reference to FIG. 1, printhead assembly 12 is a non-scanning type printhead assembly. As such, mounting assembly 16 positions printhead assembly 12 so as to orient column 30 of nozzles 13 at angle 29, as described above. In addition, mounting assembly 16 fixes printhead assembly 12 at a prescribed position relative to media transport assembly 18 as media transport assembly 18 advances print media 19 past the prescribed position during printing. For example, print media 19 is advanced relative to printhead assembly 12 along axis 27 in a direction indicated by arrow 199.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A printhead for printing on a print media, the printhead comprising:

a first column of nozzles and a second column of nozzles each oriented at an angle to an axis of relative movement between the printhead and the print media; and a print axis oriented substantially parallel to the axis of relative movement between the printhead and the print media, wherein the first column of nozzles and the second column of nozzles are oriented substantially parallel to each other and substantially overlap in a direction substantially perpendicular to the print axis, wherein at least some of the nozzles including at one nozzle of the first column of nozzles and at least one nozzle of the second column of nozzles are variably aligned to the print axis.

2. The printhead of claim 1, wherein the at least some of the nozzles are intersected by the print axis.

3. The printhead of claim 1, wherein one of the at least some of the nozzles is offset a first distance from the print axis and another of the at least some of the nozzles is offset a second distance from the print axis, wherein the second distance differs from the first distance.

4. The printhead of claim 1, wherein one of the at least some of the nozzles is offset from the print axis in a first direction and another of the at least some of the nozzles is offset from the print axis in a second direction opposite the first direction.

5. The printhead of claim 1, wherein the at least some of the nozzles includes adjacent nozzles of at least one of the first column of nozzles and the second column of nozzles.

6. The printhead of claim 1, wherein the angle is an acute angle.

7. The printhead of claim 1, wherein the printhead is a non-scanning printhead.

8. The printhead of claim 1, wherein the printhead is a scanning printhead.

9. A printhead for printing on a print media, the printhead comprising:

a plurality of nozzles divided into subgroups of nozzles and including a first column of nozzles and a second column of nozzles each oriented at an angle to an axis of relative movement between the printhead and the print media; and a plurality of print axes oriented substantially parallel to the axis of relative movement between the printhead and the print media, wherein the first column of nozzles and the second column of nozzles are oriented substantially parallel to each other and substantially overlap in a direction substantially perpendicular to the print axes, wherein nozzles within each one of the subgroups are variably aligned to one of the print axes.

10. The printhead of claim 9, wherein nozzles within each one of the subgroups are intersected by one of the print axes.

11. The printhead of claim 9, wherein one of the nozzles within one of the subgroups is offset a first distance from one of the print axes and another of the nozzles within the one of the subgroups is offset a second distance from the one of the print axes, wherein the second distance differs from the first distance.

12. The printhead of claim 9, wherein one of the nozzles within one of the subgroups is offset from one of the print axes in a first direction and another of the nozzles within the one of the subgroups is offset from the one of the print axes in a second direction opposite the first direction.

13. The printhead of claim 9, wherein at least one of the subgroups of nozzles includes multiple nozzles of at least one of the first column of nozzles and the second column of nozzles.

14. The printhead of claim 9, wherein at least one of the subgroups of nozzles includes adjacent nozzles of at least one of the first column of nozzles and the second column of nozzles.

15. The printhead of claim 9, wherein at least one of the subgroups of nozzles includes at least one nozzle of the first column of nozzles and at least one nozzle of the second column of nozzles.

16. The printhead of claim 9, wherein the printhead is adapted to eject fluid through all of the nozzles within one of the subgroups to produce a dot pattern along one of the print axes.

17. The printhead of claim 9, wherein the printhead is adapted to eject fluid through less than all of the nozzles within one of the subgroups to produce a dot pattern along one of the print axes.

18. The printhead of claim 9, wherein the printhead is adapted to eject fluid through only one of the nozzles within one of the subgroups to produce a dot pattern along one of the print axes.

19. The printhead of claim 9, wherein the printhead is adapted to eject fluid through any one of the nozzles within one of the subgroups to produce a dot pattern along one of the print axes.

20. The printhead of claim 9, wherein the printhead is adapted to eject fluid through multiple nozzles within one of the subgroups to print overlapping dots along one of the print axes.

21. The printhead of claim 20, wherein the overlapping dots increase resolution.

22. The printhead of claim 20, wherein the overlapping dots increase dot size.

23. The printhead of claim 9, wherein the printhead is adapted to eject fluid through multiple nozzles within one of the subgroups to print multiple dots along one of the print axes.

24. The printhead of claim 9, wherein the angle is an acute angle.

25. The printhead of claim 9, wherein the printhead is a non-scanning printhead.

26. The printhead of claim 9, wherein the printhead is a scanning printhead.

27. A printhead arrangement for printing on a print media, the printhead arrangement comprising:

a first printhead including a first plurality of nozzles; and a second printhead adjacent the first printhead and including a second plurality of nozzles, wherein the first plurality of nozzles of the first printhead and the second plurality of nozzles of the second printhead each include at least one column of nozzles oriented at an angle to an axis of relative movement between the printhead arrangement and the print. media, and wherein at least one nozzle of the first plurality of nozzles and at least one nozzle of the second plurality of nozzles is included in a subgroup of nozzles each variably aligned to one of a plurality of print axes oriented substantially parallel to the axis of relative movement between the printhead arrangement and the print media, wherein the first plurality of nozzles and the second plurality of nozzles substantially overlap in a direction substantially perpendicular to the print axes.

28. The printhead arrangement of claim 27, wherein nozzles within the subgroup of nozzles are intersected by the one of the print axes.

29. The printhead arrangement of claim 27, wherein one of the nozzles within the subgroup of nozzles is offset a first distance from the one of the print axes and another of the nozzles within the subgroup of nozzles is offset a second distance from the one of the print axes, wherein the second distance differs from the first distance.

30. The printhead arrangement of claim 27, wherein one of the nozzles within the subgroup of nozzles is offset from the one of the print axes in a first direction and another of the nozzles within the subgroup of nozzles is offset from the one of the print axes in a second direction opposite the first direction.

31. The printhead arrangement of claim 27, wherein the angle is an acute angle.

32. A printhead for printing on a print media, the printhead comprising:

a first column of nozzles and a second column of nozzles;

a print axis oriented substantially parallel to an axis of relative movement between the printhead and the print media; and means for variably aligning at least some of the nozzles including at one nozzle of the first column of nozzles and at least one nozzle of the second column of nozzles to the print axis.

wherein the first column of nozzles and the second column of nozzles are oriented substantially parallel to each other and substantially overlap in a direction substantially perpendicular to the print axis.

33. The printhead of claim 32, wherein means for variably aligning at least some of the nozzles includes the first column of nozzles and the second column of nozzles oriented at an angle to the axis of relative movement between the printhead and the print media.

34. The printhead of claim 32, wherein means for variably aligning at least some of the nozzles further includes means for varying an offset distance from the print axis to the at least some of the nozzles.

35. The printhead of claim 34, wherein means for varying the offset distance includes the first column of nozzles and the second column of nozzles oriented at varied angles to the axis of relative movement between the printhead and the print media.

36. The printhead of claim 32, wherein means for variably aligning at least some of the nozzles further includes means for varying a number of the at least some of the nozzles.

37. The printhead of claim 36, wherein means for varying the number of the at least some of the nozzles includes the first column of nozzles and the second column of nozzles oriented at varied angles to the axis of relative movement between the printhead and the print media.

38. A printhead for printing on a print media, the printhead comprising:

a plurality of nozzles divided into subgroups of nozzles and including a first column of nozzles and a second of nozzles;

a plurality of print axes oriented substantially parallel to an axis of relative movement between the printhead and the print media; and means for variably aligning nozzles within each one of the subgroups to one of the print axes, wherein the first column of nozzles and the second column of nozzles are oriented substantially parallel to each other and substantially overlap in a direction substantially perpendicular to the print axes.

39. The printhead of claim 38, wherein means for variably aligning the nozzles includes the first column of nozzles and the second column of nozzles oriented at an angle to the axis of relative movement between the printhead and the print media.

40. The printhead of claim 38, wherein means for variably aligning the nozzles further includes means for varying an offset distance from one of the print axes to the nozzles within each one of the subgroups.

41. The printhead of claim 40, wherein means for varying the offset distance provides means for varying resolution of the printhead.

42. The printhead of claim 40, wherein means for varying the offset distance provides means for varying dot size along the print axes.

43. The printhead of claim 40, wherein means for varying the offset distance includes the first column of nozzles and the second column of nozzles oriented at varied angles to the axis of relative movement between the printhead and the print media.

44. The printhead of claim 38, wherein means for variably aligning the nozzles further includes means for varying a number of nozzles within the subgroups.

45. The printhead of claim 44, wherein means for varying the number of nozzles within the subgroups provides means for varying print speed of the printhead.

46. The printhead of claim 44, wherein means for varying the number of nozzles within the subgroups provides means for varying nozzle redundancy along the print axes.

47. The printhead of claim 45, wherein means for varying the number of nozzles within the subgroups includes the first column of nozzles and the second column of nozzles oriented at varied angles to the axis of relative movement between the printhead and the print media.

* * * * *

UNITED STATES PATENT AND TRADEMARK OFFICE

CERTIFICATE OF CORRECTION

PATENT NO. : 6,966,627 B2
APPLICATION NO. : 10/608642
DATED : November 22, 2005
INVENTOR(S) : Victor T. Escobedo et al.

It is certified that error appears in the above-identified patent and that said Letters Patent is hereby corrected as shown below:

In column 7, line 33, in Claim 1, after "at" insert -- least --.

In column 9, line 10, in Claim 27, delete "print." and insert -- print --, therefor.

In column 9, line 46, in Claim 32, after "at" insert -- least --.

In column 9, line 48, in Claim 32, delete "axis." and insert -- axis, --, therefor.

In column 10, line 16, in Claim 38, after "second" insert -- column --.

In column 10, line 57, in Claim 47, delete "claim 45" and insert -- claim 44 --, therefor.

Signed and Sealed this

Fifteenth Day of December, 2009

David J. Kappos

David J. Kappos
*Director of the United States Patent and Trademark Office*